US011236480B2

(12) United States Patent
Domanski et al.

(10) Patent No.: US 11,236,480 B2
(45) Date of Patent: Feb. 1, 2022

(54) TRENCH CUTTER AND METHOD FOR PRODUCING A CUT TRENCH IN THE SOIL

(71) Applicant: BAUER Spezialtiefbau GmbH, Schrobenhausen (DE)

(72) Inventors: Thomas Domanski, Petaling Jaya (MY); Karl Van Der Waal, Shah Alam (MY)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 16/982,015

(22) PCT Filed: Mar. 6, 2019

(86) PCT No.: PCT/EP2019/055606
§ 371 (c)(1),
(2) Date: Sep. 17, 2020

(87) PCT Pub. No.: WO2019/179770
PCT Pub. Date: Sep. 26, 2019

(65) Prior Publication Data

US 2021/0095435 A1 Apr. 1, 2021

(30) Foreign Application Priority Data

Mar. 21, 2018 (EP) ..... 18163075

(51) Int. Cl.
*E02D 3/12* (2006.01)
*E02F 3/92* (2006.01)
(Continued)

(52) U.S. Cl.
CPC ..... *E02D 3/126* (2013.01); *E02D 17/13* (2013.01); *E02F 3/9218* (2013.01);
(Continued)

(58) Field of Classification Search
CPC ..... E02D 3/126; E02D 17/13; E02F 3/9218; E02F 3/9231; E02F 3/9275; E02F 3/961;
(Continued)

(56) References Cited

U.S. PATENT DOCUMENTS 2,241,383 A * 5/1941 Barnett ..... A01G 23/06 37/94
3,554,602 A * 1/1971 Chaney ..... E02F 3/18 299/17
(Continued)

FOREIGN PATENT DOCUMENTS

DE 2300446 A1 7/1973
DE 4141629 A1 6/1993
(Continued)

OTHER PUBLICATIONS

International Search Report issued in PCT/EP2019/055606; dated Apr. 10, 2019.
(Continued)

*Primary Examiner* — Edwin J Toledo-Duran
(74) *Attorney, Agent, or Firm* — Studebaker & Brackett PC

(57) ABSTRACT

The invention relates to a trench cutter and a method for producing a cut trench in the soil having a cutter frame, at least one pair of cutting wheels which are supported and driven in a rotatable manner on a lower end of the cutter frame, wherein each cutting wheel has a plurality of cutting teeth along its outer circumference, and a supply and/or discharge means for supplying or discharging a cutting liquid to or from the cut trench in the region of the cutting wheels. According to the invention provision is made in that spaced from the supply and/or discharge means a cleaning device is provided for cleaning the cutting wheels during the cutting operation with a cleaning fluid and in that the cleaning device has a plurality of cleaning nozzles which are
(Continued)

Figure 1:
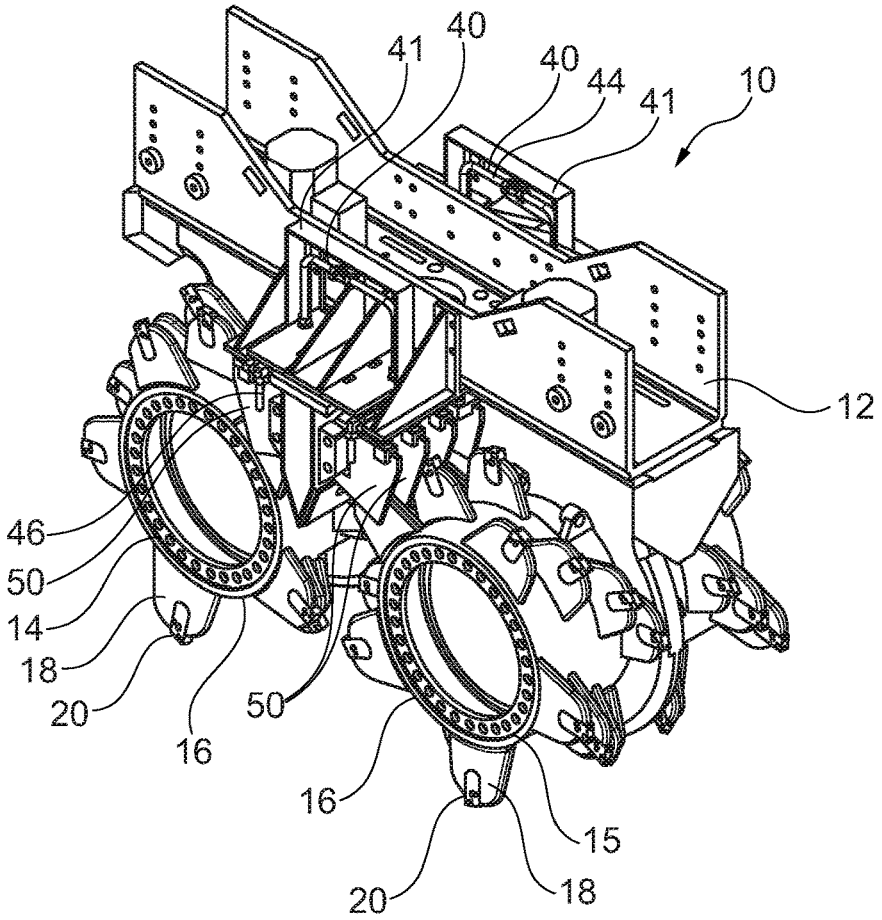

directed onto the outer circumference of at least one cutting wheel and designed to inject the cleaning fluid to loosen adhering soil material.

12 Claims, 2 Drawing Sheets

(51) Int. Cl.
*E02D 17/13* (2006.01)
*E02F 3/96* (2006.01)

(52) U.S. Cl.
CPC ..... *E02F 3/9231* (2013.01); *E02F 3/9275* (2013.01); *E02F 3/961* (2013.01)

(58) Field of Classification Search
CPC . E02F 5/102; E02F 5/103; E02F 5/104; E02F 3/205
See application file for complete search history.

(56) References Cited

U.S. PATENT DOCUMENTS 3,960,407 A * 6/1976 Noren ..... E21C 25/60 299/17
4,091,629 A * 5/1978 Gunn ..... G02B 6/4465 405/165
4,111,490 A * 9/1978 Liesveld ..... B05B 1/10 239/101
4,167,292 A * 9/1979 Eller ..... E21C 41/31 299/17
4,240,664 A * 12/1980 Mahyera ..... E21C 25/60 239/550
4,280,572 A * 7/1981 Schmid ..... B25D 17/02 175/393
4,282,985 A * 8/1981 Yamamoto ..... A01C 7/04 111/152
4,327,507 A * 5/1982 Volbeda ..... E02F 3/9231 175/67
4,342,526 A * 8/1982 Mousselli ..... E02D 15/10 37/142.5
4,386,473 A * 6/1983 Amann ..... E02F 3/905 37/319
4,397,106 A * 8/1983 MdDowell ..... E02F 3/248 37/329
4,548,442 A * 10/1985 Sugden ..... E21D 9/1093 299/10
4,573,743 A * 3/1986 Grathoff ..... E02F 3/9237 37/190
4,680,879 A * 7/1987 Hill ..... E02F 3/9231 277/379
4,877,355 A * 10/1989 Van Pelt ..... E02F 5/104 405/159
4,946,227 A * 8/1990 Paul ..... E02F 3/24 299/17
5,070,286 A * 12/1991 Soulard ..... E02F 3/427 318/568.1
5,275,513 A * 1/1994 Geary, Jr ..... E02D 3/126 405/263
5,631,160 A * 5/1997 Bruso ..... B09C 1/00 405/128.5
6,409,276 B1 * 6/2002 Sult ..... E21C 25/10 299/17
6,449,883 B1 * 9/2002 Vandycke ..... E02F 3/9262 37/323
7,604,301 B1 * 10/2009 Lang ..... E02D 3/126 299/68
2006/0037218 A1 * 2/2006 Stoetzer ..... E02D 17/13 37/352
2008/0008540 A1 * 1/2008 Trevisani ..... E02F 3/205 405/233
2012/0114427 A1 * 5/2012 Allen ..... E02D 3/126 405/266
2012/0308306 A1 * 12/2012 Kruse ..... E02F 5/16 405/128.75
2017/0204581 A1 * 7/2017 Darson Balleur ..... E02D 3/126
2019/0015766 A1 * 1/2019 Hofland ..... B04C 9/00
2019/0136488 A1 * 5/2019 Cochran ..... E01C 23/096
2019/0269060 A1 * 9/2019 Nance ..... A01B 21/086
2020/0306803 A1 * 10/2020 Jacobsen ..... E02D 13/08

FOREIGN PATENT DOCUMENTS

EP 1452645 A1 9/2004
EP 2685007 A1 1/2014
EP 2703565 A1 3/2014

OTHER PUBLICATIONS

International Preliminary Report on Patentability issued in PCT/EP2019/055606; Date of completion of this report: Mar. 5, 2020.

* cited by examiner

TRENCH CUTTER AND METHOD FOR PRODUCING A CUT TRENCH IN THE SOIL

The invention relates to a trench cutter for producing a cut trench in the soil having a cutter frame, at least one pair of cutting wheels which are supported and driven in a rotatable manner on the cutter frame, wherein each cutting wheel has a plurality of cutting teeth along its outer circumference, and a supply and/or discharge means for supplying or discharging a cutting liquid to or from the cut trench in the region of the cutting wheels.

The invention further relates to a method for producing a cut trench in the soil with such a trench cutter, wherein the cutting wheels are driven in a rotating manner and the trench cutter is sunk into the soil and soil material is cut off, wherein the cut trench is produced in the soil.

Trench cutters of such type are used for the production of so-called diaphragm walls or cut-off walls that are required e.g. for securing or sealing construction pits. By means of a trench cutter a first cut trench is produced which is filled with a hardenable mass. This mass hardens into a diaphragm wall segment. Through a sequence of several diaphragm wall segments it is thus possible to produce a diaphragm wall of a desired size.

From EP 1 452 645 A1 a generic trench cutter for producing a diaphragm wall in the soil can be taken. Between the two cutting wheel pairs a supply means opens out, by means of which a settable liquid can be introduced into the cut trench in the region between the cutting wheels. Through the rotating movement of the cutting wheels the supplied settable liquid is mixed with the cut-off soil material to a hardenable mass which can then harden into the diaphragm wall segment. In this known method the cut-off soil material is mixed to the hardenable mass directly in-situ in the cut trench.

Another method for producing a diaphragm wall segment in the soil can be taken from DE 41 41 629 A1. In the trench cutter employed for this purpose a discharge means is provided between the cutting wheels, with which the cut-off soil material is directly sucked off above ground together with stabilizing fluid present in the cut trench. The sucked-off suspension can be depleted of soil material in a separation means and returned to an upper region of the cut trench. In doing so, the suspension can be treated such that this constitutes a hardenable mass which hardens in the cut trench into the diaphragm wall segment.

When producing a cut trench by means of a trench cutter there is the fundamental problem that during cutting in cohesive soils, i.e. for example in clay, slit, claystone etc., the soil stripped by the cutting wheels adheres to the cutting teeth of the cutting wheels and can thus clog up the cutting wheels. This can have the effect that the clogging-up is of such gravity that the trench cutter has to be withdrawn from the cut trench to clean the cutting wheels mechanically. Due to the fact that cut trenches can reach a depth of 40 meters and more this is very time-consuming and therefore presents an economic drawback. As a result, the daily cutting performance of a trench cutter can be reduced noticeably.

To loosen adhering soil material between annular rows of cutting teeth on a cutting wheel it is known from EP 2 685 007 A 1 for example that on the cutting wheel frame so-called reamer plates are mounted that protrude into the spaces between the annular rows of cutting teeth. However, the reamer plates have to keep a certain distance to the cutting wheels and the cutting teeth so that only a partial removal of adhering soil material can be achieved thereby.

The invention is based on the object to provide a trench cutter and a method for producing a cut trench in the soil, with which a cut trench can be produced in a particularly efficient manner.

The trench cutter according to the invention is characterized in that spaced from the supply and/or discharge means a cleaning device is provided for cleaning the cutting wheels during the cutting operation with a cleaning fluid and in that the cleaning device has a plurality of cleaning nozzles which are directed onto the outer circumference of at least one cutting wheel and designed to inject the cleaning fluid to loosen adhering soil material.

A basic idea of the invention resides in the fact that spaced apart or separate from the supply and/or discharge means for a cutting liquid a cleaning device is provided, by which the cutting wheels can be cleaned during the cutting operation using a cleaning fluid. By means of a cleaning fluid the cutting wheels, and in particular the cutting teeth, can be cleaned in a particularly reliable manner and without a substantial degree of wear during the cutting operation, in which the cutting wheels rotate and strip soil material.

One aspect of the invention resides in the fact that the cleaning device has a plurality of cleaning nozzles which are directed onto the outer circumference of at least one cutting wheel and designed to inject the cleaning fluid to loosen soil material adhering to the cutting teeth. The cleaning fluid can be a liquid or a gas or a gas-liquid mixture. The cleaning nozzles are spaced from the supply means for cutting liquid which, for the purpose of operating the cutter, supplies a relatively large amount of cutting liquid into the cut trench in a cutting method with in-situ mixing. By arranging a plurality of cleaning nozzles that are specifically oriented to the cutting wheels and in particular to the cutting teeth and tooth holders a targeted loosening of adhering soil material can be accomplished. As a result, even in the case of longer operating times when cutting off cohesive soil material the cutting wheels substantially show a consistently high cutting performance without there being the need to interrupt the cutting operation in order to clean the trench cutter above ground. This not only increases the daily cutting performance of a cutter but also leads to an improved quality of the hardenable mass in the cut trench since the cut trench can preferably be worked in one move of the trench cutter. Moreover, the cutting resistance and therefore the energy consumption is reduced.

A preferred embodiment of the trench cutter according to the invention resides in the fact that two pairs of cutting wheels are provided and that the supply and/or discharge means is arranged in a center between the two cutting wheels. The cutting wheels of a pair are supported in a rotatable manner about a joint axis of rotation. By preference, the axis of rotation is arranged horizontally during the cutting operation. The axes of rotation of the two pairs are arranged in parallel. The supply and/or discharge means is arranged in the center between the two cutting wheels so that the cutting liquid can be supplied or discharged centrally. The cleaning devices with the cleaning nozzles for the individual cutting wheels are in each case arranged by being spaced laterally from the center in relation to the respective cutting wheels.

In a simple embodiment provision can be made for stationary cleaning nozzles. In particular for the setting to adapt to altered soils and tooth arrangements it is preferred in accordance with a further development of the invention that the cleaning nozzles are supported in an adjustable manner. For instance, ball-type nozzles can be provided that can be clamped in a set position by means of a corresponding union nut.

According to another embodiment of the invention it is advantageous that the cleaning device has nozzle rails, wherein one nozzle rail is in each case arranged along the outer circumference of each cutting wheel and runs approximately parallel to the axis of rotation of the cutting wheel. Basically, for each cutting wheel provision can also be made for several nozzle rails. A nozzle rail can be referred to as a so-called common rail which is supplied with cleaning fluid via a supply line from a central pressure generating means, more particularly an injection pump. By way of corresponding setting valves located on the individual cleaning nozzles or nozzle rails different injection quantities and injection pressures can also be provided and set on the individual cleaning nozzles.

A trench cutter of such type is preferably developed further in that on the nozzle rail bar-shaped cleaning nozzles are fixed, in that the cutting teeth on a cutting wheel are arranged in annular cutting tooth rows which, by forming annular spaces, are spaced axially from each other, and in that the bar-shaped cleaning nozzles protrude into the annular interspaces. Especially when cutting off cohesive soils use is made of cutting wheels, on which the cutting teeth are arranged in annular cutting tooth rows that are axially offset to each other on the outer circumference of a cutting wheel. Between the annular cutting tooth rows annular spaces are formed, into which the bar-shaped cleaning nozzles protrude. The bar-shaped cleaning nozzles extend from the respective nozzle rail towards the cutting wheel center. The bar-shaped cleaning nozzles can have one nozzle opening or also several nozzle openings so that targeted nozzle jets can be directed onto the cutting teeth in the cutting tooth rows or the outer circumference of the cutting wheels. On the cleaning openings adjustable nozzles can be provided.

Basically, cleaning of the cutting wheels during the cutting operation can solely be achieved by the cleaning device with the cleaning fluid. According to a further development of the invention a particularly good cleaning is attained in that on the cutter frame reamer plates are arranged for scraping off adhering soil material from the cutting wheels. Reamer plates are generally known from prior art. These are mechanical scraping means which preferably reach into the annular spaces between the annular cutting tooth rows in order to scrape soil material out of the spaces which is situated there. However, the mechanical reamer plates must be arranged at a certain distance to the cutting tooth rows to prevent collisions during the cutting operation that might occur due to vibrations of the individual machine parts in operation. In addition to this mechanical cleaning remaining residual soil material can be removed by the cleaning fluid with the cleaning device according to the invention.

According to a further development of the invention it is particularly advantageous that the cleaning nozzles are integrated into the reamer plates or fixed close thereto. For instance, the reamer plates themselves can be designed as hollow plates, in which case the hollow space serves as supply of cleaning fluid to the cleaning nozzles on the reamer plates. Alternatively, the bar-shaped cleaning nozzles can in particular be fixed on an external side of the reamer plates to remove remaining residual soil material from the cutting teeth.

An especially good cleaning is achieved according to an embodiment variant of the invention in that the nozzle rails are connected via supply lines to at least one injection pump, with which the cleaning fluid can be injected under pressure. The injection pump can be arranged above ground or on the cutter frame of the trench cutter.

According to an embodiment variant of the invention it is preferred that a control means is provided, with which the injection pressure and/or an injection quantity of the cleaning fluid can be set. Depending on the adhesive property of the soil material to be cut off an adequate injection pressure and an adequate injection quantity of cleaning fluid can be set to reliably clean the cutting teeth from soil material. At the same time, the control means also allows the setting of a desired pressure in the region of the cutting wheels, which can have a positive effect on the cutting process and the mixing of cut-off soil material with cutting liquid.

Basically, a gas or any liquid can be used as cleaning fluid. According to a further development of the invention it is especially advantageous that the cleaning fluid corresponds to the cutting liquid. In particular, the cleaning fluid can be a hardenable suspension, more particularly a cement suspension, that is used to loosen soil material. The cleaning fluid injected under pressure can at the same time assist mixing of the cut-off soil material so that especially in an in-situ method a particularly good hardenable suspension is produced to form the diaphragm wall element. As cleaning fluid water can also be provided in order that e.g. at the end of a day of operation the cutting wheels are cleaned by the cleaning device outside the cut trench.

Another preferred embodiment of the invention resides in the fact that the supply means has a supply pump for supplying the cutting liquid, wherein by way of the cutting wheels the cutting liquid and the cleaning fluid are mixed in the cut trench with cut-off soil material to a hardenable suspension. In such a trench cutter employed for an in-situ cutting and mixing method the cutting liquid is preferably used as cleaning fluid. The supply pump on the cutter frame can in this case lead both the cutting liquid to the supply means and the cleaning fluid to the cleaning nozzles. As a result, an especially efficient construction of the trench cutter can be achieved.

Alternatively, according to a further development of the invention provision can be made in that the discharge means has a suction pump, with which cutting liquid, together with the cleaning fluid and cut-off soil material, is sucked out of the cut trench. In this cutting method cutting liquid is sucked off below the cutter frame out of the cut trench via a so-called suction box at the lower end of the trench cutter by means of the suction pump and the discharge means that has one or several suction openings.

Furthermore, in the case of a trench cutter according to the invention it is preferred that on an upper end of the cutter frame a rope or a rod is fixed, with which the trench cutter is suspended and vertically adjustable on a carrier implement. Cleaning of the cutting wheels during the cutting operation can thereby take place both during cutting of the soil material and during a lifting movement by means of the rope or the rod.

The method according to the invention for cutting a cut trench in the soil with the aforementioned trench cutter is characterized in that during cutting a cleaning fluid is sprayed via a cleaning device onto the outer circumference of the cutting wheels, wherein soil material adhering to the cutting wheels is loosened. By way of the method according to the invention the previously described advantages when using a trench cutter according to the invention can be achieved.

Figure 4:
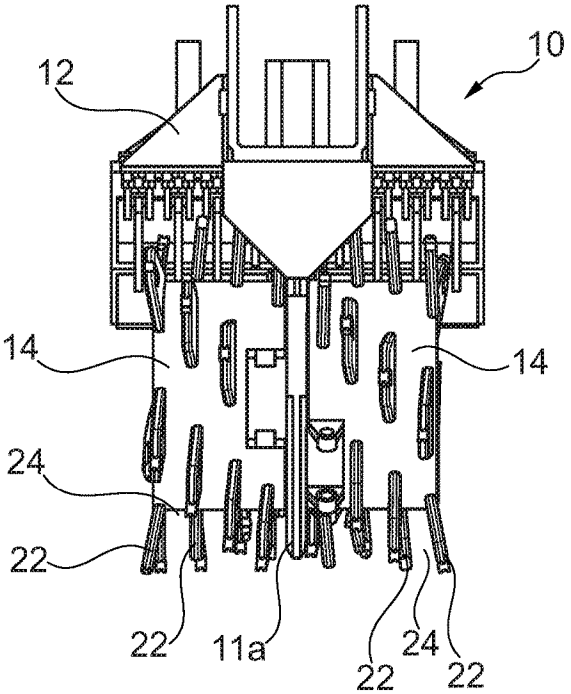
Figure 2:
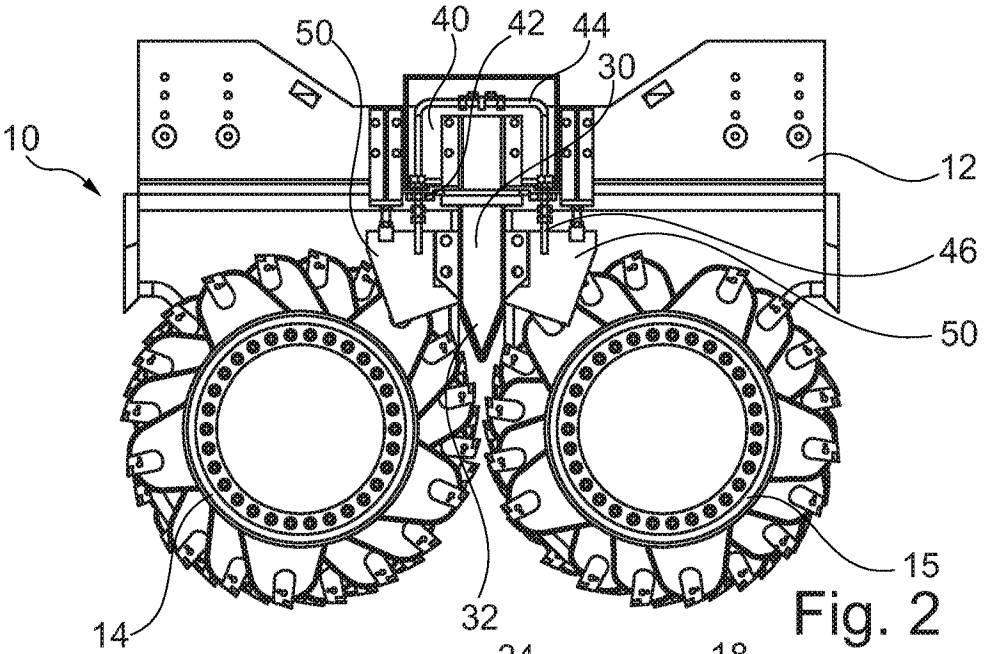
Figure 3:
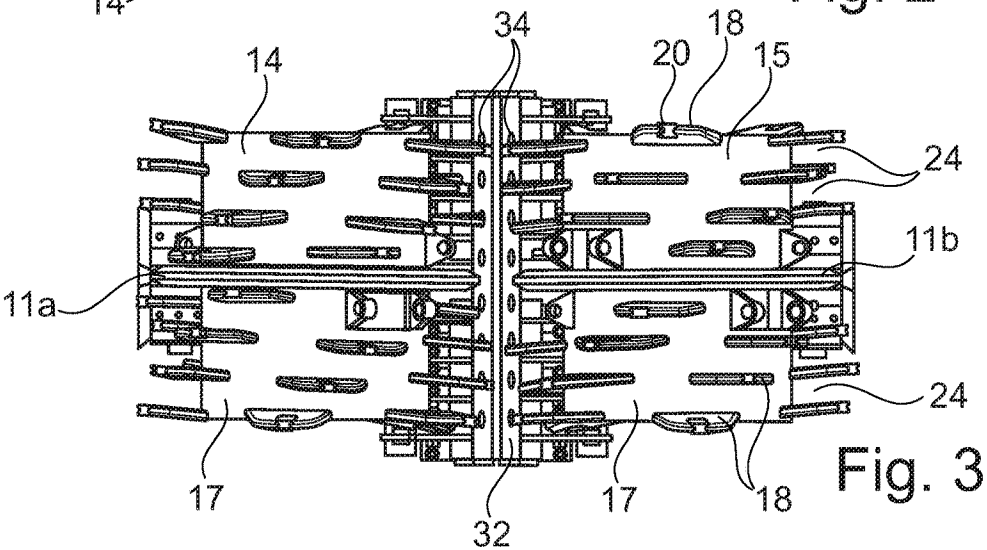

The invention is described in greater detail hereinafter by way of a preferred embodiment illustrated schematically in the Figures, wherein show:

FIG. 1 a perspective view of a lower part of a trench cutter according to the invention with the cutting wheels;

FIG. 2 a front view of the trench cutter of FIG. 1;

FIG. 3 a side view of the trench cutter of FIGS. 1 and 2;

FIG. 4 a view of the trench cutter of FIGS. 1 to 3 from below; and

Figure 5:
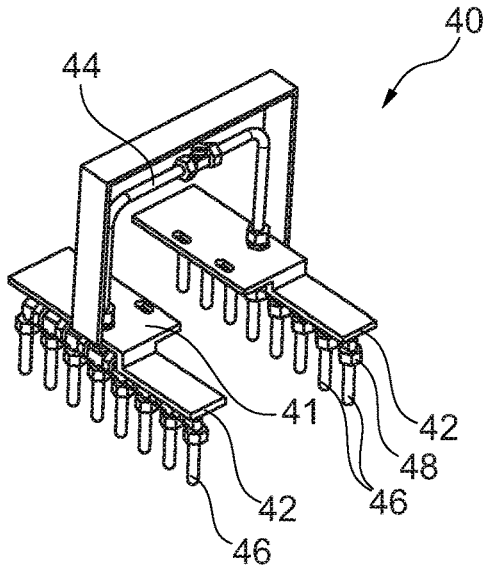

FIG. 5 a perspective view of a part of the cleaning device for the cutting wheels.

A trench cutter 10 according to the invention with a cutter frame 12 is shown in different views in FIGS. 1 to 4. On a lower end of the cutter frame 12, only shown partially, on a first gear plate 11*a* first cutting wheels 14 are arranged pairwise in a rotatable manner about a joint axis of rotation and on a second gear plate 11*b* a pair of second cutting wheels 15 are jointly supported in a rotatable manner about another axis of rotation. The cutting wheels 14, 15 each have a drum-shaped hub 17, on the outer circumference of which a plurality of cutting teeth 20 with cutting tooth holders 18 are fixed. The cutting teeth 20 are supported in a releasable manner in the cutting tooth holders 18. The cutting tooth holders 18 with the cutting teeth 20 are arranged along the outer circumference of each of the cutting wheels 14, 15 in annular cutting tooth rows 22, as can be taken from the illustration of FIGS. 3 and 4. The individual cutting tooth rows 22 are spaced axially from each other so that annular spaces 24 are formed between them.

During the cutting operation, in particular when cutting off cohesive soil such as clay, soil materials can adhere to the cutting teeth 20, the cutting tooth holders 18 and in the spaces 24 between the cutting teeth 20 or the cutting tooth holders 18. To remove adhering soil material plate-shaped reamer plates 50 are mounted on the underside of the cutter frame 12, which engage in a comb-like manner into the annular spaces 24 between the cutting teeth 20 in order to mechanically scrape off adhering soil material. The reamer plates 50 are fixed on both sides of a central discharge means 30 that is designed to suck off cutting liquid from the cut trench produced. The discharge means 30 has a suction box 32 which extends parallel to the axes of rotation and tapers in the downward direction. On its underside the suction box 32 is provided with a plurality of suction openings 34, as can be taken from the illustration of FIG. 3.

The trench cutter 10 illustrated in FIGS. 1 to 4 is designed to carry out a cutting method, in which the stripped soil material is sucked off together with surrounding stabilizing or cutting liquid from the operating region of the cutting wheels 14, 15 and is conveyed above ground. Alternatively, instead of the discharge means 30 a corresponding supply means 30 can also be provided, through which cutting liquid is supplied to the region between the cutting wheels 14, 15. Such a trench cutter 10 would be designed to carry out a cutting method, in which the stripped soil material, together with the cutting liquid, is mixed in-situ in the cut trench to a suspension that preferably hardens after removal of the trench cutter 10 from the cut trench and thereby hardens into a diaphragm wall segment or a diaphragm wall panel for a diaphragm wall.

According to the invention, spaced from both sides of the discharge means 30 a cleaning device 40 with cleaning nozzles 46 is arranged that are directed onto the outer circumference of the cutting wheels 14, 15. A part of the cleaning device 40 is shown in an enlarged illustration in FIG. 5. The cleaning device 40 has two bracket-like holding frames 41, of which one holding frame 41 is shown in FIG. 5. At the lower end of the U-shaped holding frame 41 a nozzle rail 42 is fixed in each case which is spaced from the discharge means 30 and directed parallel to the axes of rotation of the cutting wheels 14, 15. The two nozzle rails 42 of two cutting wheels 14, 15 lying opposite in each case are connected via a supply line 44, only illustrated partially, to a non-depicted supply pump. Via the supply pump a cleaning fluid, in particular a liquid, can be supplied under pressure via the supply lines 44 to the nozzle rails 42.

On an underside of the nozzle rails 42 bar-shaped cleaning nozzles 46 are fixed that are adjustable by way of clamping nuts 48. Through the clamping nuts 48 the cleaning nozzles 46 can be released and altered at least in some regions in their orientation and in this way set to the respective arrangement of cutting teeth 20 on the cutting wheels 14, 15. The cleaning nozzles 46 have nozzle openings, from which the cleaning fluid emerges under pressure in order that soil material adhering to the cutting teeth 20 and the cutting tooth holders 18 is loosened during the cutting operation. The cleaning nozzles 46 engage in a comb-like manner into the annular spaces 24.

The supply pump for injecting the cleaning fluid into the cleaning nozzles 46 can preferably be arranged on the cutter frame 12 of the trench cutter 10. By preference, the cutting liquid present in the cut trench can be used as cleaning fluid.

By way of the described trench cutter 10 according to the invention the previously described method for producing a cut trench in the soil can be carried out, wherein during the cutting operation with rotating cutting wheels 14, 15 adhering soil material can be loosened from the cutting wheels 14, 15 by the cleaning device 40.

The invention claimed is:

1. A trench cutter for producing a cut trench in the soil to produce a diaphragm wall for a construction pit, comprising:

a cutter frame, at least one pair of cutting wheels which are supported and driven in a rotatable manner on a lower end of the cutter frame, each cutting wheel having a plurality of cutting teeth along its outer circumference, a supply and/or discharge means for supplying or discharging a cutting liquid to or from the cut trench in the region of the cutting wheels, and a cleaning device spaced from the supply and/or discharge means and configured for cleaning the cutting wheels during the cutting operation with a cleaning fluid, wherein the cleaning device includes a plurality of cleaning nozzles which are directed onto the outer circumference of at least one cutting wheel and designed to inject the cleaning fluid to loosen adhering soil material, reamer plates are arranged on the cutter frame and configured for scraping off adhering soil material from the cutting wheels, and the cleaning nozzles are arranged between the reamer plates.

2. The trench cutter according to claim 1, wherein two pairs of cutting wheels are provided, and the supply and/or discharge means is arranged in a center between the two cutting wheels.

3. The trench cutter according to claim 1, wherein the cleaning nozzles are supported in an adjustable manner.

4. The trench cutter according to claim 1, wherein the cleaning device has nozzle rails, one nozzle rail being arranged along the outer circumference of each cutting wheel and running approximately parallel to the axis of rotation of the cutting wheel.

5. The trench cutter according to claim 4,
wherein
the cleaning nozzles are fixed on the nozzle rail,
the cleaning nozzles are bar-shaped,
the cutting teeth on a cutting wheel are arranged in annular cutting tooth rows which, by forming annular spaces, are spaced axially from each other, and
the cleaning nozzles protrude into the annular spaces.

6. The trench cutter according to claim 4,
wherein the nozzle rails are connected via supply lines to at least one injection pump configured to inject the cleaning fluid under pressure.

7. The trench cutter according to claim 6,
further comprising:
a control means configured to set the injection pressure and/or an injection quantity of the cleaning fluid.

8. The trench cutter according to claim 1,
wherein the cleaning fluid corresponds to the cutting liquid.

9. The trench cutter according to claim 1,
wherein
the supply means includes a supply pump for supplying the cutting liquid, wherein the cutting wheels are configured to mix the cutting liquid and the cleaning fluid in the cut trench with cut-off soil material to form a hardenable suspension.

10. The trench cutter according to claim 1,
wherein
the discharge means includes a suction pump configured to suck cutting liquid, the cleaning fluid, and cut-off soil material out of the cut trench.

11. The trench cutter according to claim 1,
further comprising:
a rope or a rod fixed on an upper end of the cutter frame configured to suspend and vertically adjust the trench cutter on a carrier implement.

12. A method for cutting a cut trench in the soil with a trench cutter according to claim 1, comprising:
driving the cutting wheels in a rotating manner, sinking the trench cutter into the soil, and cutting off the soil material such that the cut trench is produced in the soil,
spraying the cleaning fluid during the cutting via the cleaning device onto the outer circumference of the cutting wheels such that soil material adhering to the cutting wheels is loosened,
scraping off adhering soil material from the cutting wheels with the reamer plates which are arranged on the cutter frame, and
spraying the cleaning fluid onto the outer circumference of the cutting wheels with the cleaning nozzles which are arranged between the reamer plates.

* * * * *